US005189399A

United States Patent [19]

Beyersdorf

[11] Patent Number: 5,189,399

[45] Date of Patent: Feb. 23, 1993

[54] METHOD OF OPERATING AN IONIZATION SMOKE ALARM AND IONIZATION SMOKE ALARM

[76] Inventor: Hartwig Beyersdorf, Travemünder Allee 6 a, 2400 Lübeck, Fed. Rep. of Germany

[21] Appl. No.: 796,904

[22] Filed: Nov. 22, 1991

Related U.S. Application Data

[63] Continuation of Ser. No. 480,849, Feb. 16, 1990, abandoned.

[30] Foreign Application Priority Data

Feb. 18, 1989 [DE] Fed. Rep. of Germany ..... 3904979

[51] Int. Cl.[5] ..... G08B 17/10

[52] U.S. Cl. ..... 340/629; 250/385.1

[58] Field of Search ..... 340/629; 250/383, 384, 250/385.1

[56] References Cited

U.S. PATENT DOCUMENTS

| | | | |
|---|---|---|---|
| 3,795,904 | 3/1974 | Beyersdorf et al. | 340/629 |
| 3,963,929 | 6/1976 | Beyersdorf | 340/629 |
| 4,254,414 | 3/1981 | Street et al. | 340/627 |
| 4,335,379 | 6/1982 | Coleman | 340/629 |
| 4,388,616 | 6/1983 | Machida | 340/629 |
| 4,401,978 | 8/1983 | Solomon | 340/629 |
| 4,456,907 | 6/1984 | Johnson | 340/629 |

FOREIGN PATENT DOCUMENTS

| | | |
|---|---|---|
| 0033888 | 1/1981 | European Pat. Off. . |
| 0067339 | 5/1982 | European Pat. Off. . |
| 0070449 | 7/1982 | European Pat. Off. . |
| 0121048 | 2/1984 | European Pat. Off. . |
| 1259227 | 1/1968 | Fed. Rep. of Germany . |
| 2019791 | 3/1972 | Fed. Rep. of Germany . |
| 2004584 | 7/1972 | Fed. Rep. of Germany . |
| 2121382 | 12/1972 | Fed. Rep. of Germany . |
| 2027064 | 1/1973 | Fed. Rep. of Germany . |
| 2029794 | 4/1973 | Fed. Rep. of Germany . |
| 2050719 | 9/1973 | Fed. Rep. of Germany . |
| 2257931 | 3/1978 | Fed. Rep. of Germany . |
| 2946507 | 5/1980 | Fed. Rep. of Germany . |
| 3200620 | 9/1982 | Fed. Rep. of Germany . |
| 3050185 | 12/1982 | Fed. Rep. of Germany . |
| 3004753 | 12/1983 | Fed. Rep. of Germany . |
| 552989 | 8/1974 | Switzerland . |
| 620905 | 5/1982 | Switzerland . |

*Primary Examiner*—Coles, Sr., Edward L.
*Assistant Examiner*—Jill Jackson
*Attorney, Agent, or Firm*—Kinney & Lange

[57] ABSTRACT

A method of the operation of an ionization smoke alarm which has a measuring chamber open to the ambient air and ionizable by a radioactive source. A measuring chamber includes a first electrode to which a supply d.c. voltage is applied and a measuring electrode the potential of which changes in response to the smoke density if smoke enters the measuring chamber. This potential is measured for producing a smoke alarm signal if it reaches a predetermined value. The potential of the measuring electrode is measured for at least one further electric field strength that is compared with at least a second potential which occurs at the second field strength according to the law of the agglomeration of small ions if smoke aerosols are present in the measuring chamber.

30 Claims, 4 Drawing Sheets

METHOD OF OPERATING AN IONIZATION SMOKE ALARM AND IONIZATION SMOKE ALARM

This is a continuation of application Ser. No. 480,989, filed Feb. 16, 1990, now abandoned.

BACKGROUND OF THE INVENTION

The invention is directed to an ionization smoke alarm and a method of operating it to distinguish between smoke and contamination.

It is known to detect the increasing aerosol content (smoke) in the air by means of an open ionization chamber. A radioactive member generates an ion current in the ionization chamber which current is decreased by the so-called small ion agglomeration effect if smoke aerosols are present. Conventional ionization smoke alarms give an alarm through the alarm line if a predetermined threshold for the ion current or a potential generated thereby (at the measuring electrode) is exceeded or is not reached. In recent times, more and more so-called analog alarms have been used (German Publication Letter 22 57 931, German Disclosure Letter 29 46 507, EP 0 070 449). According to these alarms, a corresponding signal for the evaluation means used therein is generated in response to the analog value of the measuring chamber current.

Normally, a fire alarm unit consists of a plurality of fire alarms which are connected in groups with a fire alarm central office by means of current supply lines and signal lines. The evaluation of the analog signals makes necessary an associated definite identification signal for each alarm as well as for its respective measuring value. An output of analog signals in short time intervals is necessary in order to recognize a fire immediately. Since a great number of fire alarms are normally connected to a common cable, an agglomeration of signals result. Both a high-grade alarm identification word consisting of a signal sequence and an identification data word containing the associated analog value for each alarm, as well as a high-grade cable network, are all absolutely necessary for a safe communication to the central office which is often far away from the alarms (EP 0 121 048 or also EP 0 070 449). Also in the central office relatively high expenses are necessary for the data processing of the plurality of signal sequences (EP 0 067 339).

These expenses are made in order to recognize as early as possible modifications of the measuring chamber current which are not caused by fire and to avoid false alarms (German Publication Letter 22 57 931 or German Disclosure Letter 29 46 507).

Apart from climatic influences, as for instance temperature, pressure etc., as well as aging effects, especially of the radioactive member, the correct operation of such smoke alarms is influenced by contamination which naturally varies considerably depending on which atmosphere the alarm is exposed to. One distinguishes substantially between two detrimental effects which are based upon different contamination results. If the contamination at the insulation of the structure supporting the measuring electrode predominates, a reduction of the responsiveness or even a non-response results on account of leakage currents. In order to detect this condition in time, solutions have been already proposed (German Patent Letter 20 29 794, EP 0 033 888, German Disclosure Letter 30 04 753 or German Patent Letter 20 04 584).

However, if a contamination of the radioactive member predominates, for instance on account of dirt depositions, a reduction of the measuring chamber current results on account of a reduction of the movement energy or of the ionization capability of the radioactive radiation; the ionization smoke alarm becomes more sensitive with respect to smoke. If the continuing contamination of the radioactive member is not recognized, a false alarm results if corresponding precautions are not taken.

Several solutions have been already suggested for detecting this highly critical condition of an alarm very early. So, for instance, with conventionally operating threshold alarms, one or a plurality of additional pre-alarm thresholds are provided which give an alarm for relatively small chamber current decreases (Swiss Patent Letter 629 905 or Swiss Patent Letter 574 532). In order to check the function of the ionization smoke alarms from the central office, or to determine the actual responsiveness or, more precisely stated, to determine the voltage difference which has to be overcome for giving an alarm at the measuring electrode, it has been already proposed to either continuously, or by steps, increase the voltage at the outer electrode of the measuring chamber (German Publication Letter 20 19 791, German Patent Letter 202 764 or German Patent Letter 20 50 719). Furthermore, it already has been suggested in German Disclosure Letter 21 21 382 to evaluate only such modifications of the measuring chamber current which extend for longer periods to determine whether smoke or, alternatively, dirt is the reason for a chamber current variation. Here, very slow variations of the current are attributed to the influence of dirt. Furthermore, in the last-cited publication, the installation of a radiation detector is also proposed with which the radioactivity is directly measured in order to be able to immediately identify variations of the ionization capacity. In the same publication the installation of assisting electrodes is described either to be able to better recognize or compensate an increase of the insulation leaking current.

It is also known from EP 0 121 048 to provide each ionization smoke alarm with so-called noise levels. Here, additional thresholds are formed below the alarm threshold, and additionally a superimposed long-time drifting is taken into account. A comparable method as also become known for analog alarms (EP 0 070 449).

Furthermore, it has become known from EP 0 067 339 to use modifications of the static current of the measuring chamber caused by varying environmental conditions as criterion whether the alarm is in a correct operational condition.

However, all the known methods do not shown any way to determine, in a sufficiently safe manner, whether dirt depositions on the radioactive member or floating smoke aerosols are the reason for a reduction of the measuring chamber current. The reaction of an alarm at so-called pre-alarm thresholds makes necessary an examination as to whether a fire has developed which has to be carried out directly by a person, i.e. an extensive alarm organization is required for a responsible user. Indeed, in most of the cases, contamination is the reason for triggering of the alarm based on the pre-alarm threshold; however, the danger is present that attentiveness is reduced thereby or that at least a great loss of confidence is caused. Fire alarms which does not provide an alarm for a relatively slow variation of the measuring chamber current bring the danger that they detect slowly smoldering fires very late or that they do not detect them at all. A short-time contamination of a considerably amount such as for instance, a dewing of the radioactive radiators, cannot be distinguished by means of this method from a current variation in the measuring chamber caused by a fast smoke increase.

On principle, the known analog systems also have these above-cited deficiencies. Also, even with considerable high technical efforts, only a few of the actually existing defects which are simulated by contamination can be detected. With most of the known solutions concerning analog alarms, either contamination or aging is imputed if the measuring chamber current values change very slowly, or if a rather worthless evaluation of the variations of the measuring chamber current occurring during normal operation is carried out.

It is the object of the present invention to provide an method of operating a ionization smoke alarm with which it can be recognized in a safe manner whether a modification of the measuring chamber current is caused by the entering of smoke aerosols or instead by contamination or other deteriorations of the radioactive source.

SUMMARY OF THE INVENTION

According to the inventive method, the measuring chamber current, upon a change of the field strength, will have different values depending on whether a current reduction has been caused, for instance, by contamination and thus partial coverage of the radioactive member, or by the entering of smoke aerosols. Independent of the degree of contamination, upon change of the voltage by the increase or the decrease of the applied supply voltage a measuring chamber will have another reduction behaviour for contamination than if floating smoke aerosols would be present in the measuring chamber. That is, according to the agglomeration law of Schweitler (German Publication Letter 12 53 277), the relative change of the ion concentration is a function of the duration time of the ions in a respective volume element. However, the ion duration time depends on the electric field strength. In other words, with increasing field strength in the ionization chamber, the relative change of the measuring chamber current will be decreasing at the same smoke density. At the same smoke density, with smaller field strengths (for instance in the order of a few V/cm) a greater fractional reduction of the measuring current is the result compared with the reduction at higher field strengths. The reason for this is the agglomeration capability with regard to aerosols which becomes smaller with increasing field strength.

On account of the above-cited observation, a plurality of embodiments of the inventive method is possible. The inventive method can be applied not only to an arrangement consisting of one or two ionization chambers but also to a system working with thresholds or analog values. A relatively simple embodiment of the invention can work in the following manner.

With a non-saturated ionization chamber working in a field strength range of a few Volt/cm, which is favourable for the agglomeration process of ions to smoke aerosols, a defined change of the field strength is carried out upon reaching a predetermined change of the measuring chamber current. If smoke aerosols are the reason leading to the field strength change, a corresponding new (modified) chamber current will occur in accordance with the agglomeration law. If, for instance, the field strength has become considerably higher, it is no longer optimal for the agglomeration of ions, and a correspondingly smaller value for the chamber current will occur. However, if the deposition of dirt or a humidity film on the radioactive member is the reason for the chamber current variation, the case of a field strength increase will result in a considerably greater modification of the ionization current if the other conditions are the same. On account of the evaluation of the chamber current values occurring at the different field strengths, a determination is possible as to whether a fire alarm has to be given or whether, for instance, only a cleaning of the corresponding fire alarm is necessary. Accordingly, by the invention a false alarm on account of contaminated or dewed radioactive members can be avoided.

Furthermore, the inventive method allows a field strength change in defined time intervals in order to be able to determine early the occurrence of a slightly contamination and, if necessary, to cause a corresponding correction of the responsiveness to smoke. Here, the use of the method is possible not only in ionization smoke alarms working in an analog manner but also in working as threshold alarms. So, the field strength change-over and the evaluation can be also carried out before reaching one or a plurality of different changes of the chamber current. Dependent on the degree of contamination to be permitted, either a correction of the alarm threshold at slight contamination or a service request after a certain contamination degree can be induced, or failure of the fire alarm can be indicated at high contamination. By means of the inventive method even different smoke densities can be recognized in order to induce corresponding pre-alarms and alarms. However, the detection of different smoke densities is also known in the prior art.

If one changes from a field strength favourable for smoke agglomeration, then upon an increase of the field strength in the presence of smoke, as described above, a relatively smaller change of the ion chamber current will result than if dirt depositions on the radioactive member were the reason for reaching the original chamber current change. However, if one carries out a decrease of the field strength under identical starting conditions, smoke will result in a greater chamber current change than a dirt deposition on the measuring chamber radiator.

For carrying out the inventive method, it is necessary that at least the characteristic curve in the measuring chamber (chamber current in relation to the chamber voltage) is known point by point. In order to determine the change of the potential at least at one further field strength, one can for instance refer to a potential value which a measuring chamber has in its new condition. For example, the reference values can be directly derived by measuring the new ionization chamber or from its data.

If the characteristic curve runs favourable, sometimes measuring of the potential at only one further field strength is sufficient to make a statement whether the measured potential change is caused by the presence of smoke aerosols or by dirt depositions on the radioactive member. Preferably, a measurement of the potentials at the measuring electrode is done for at least one field strength above and at least one field strength below the first field strength (operation field strength) in order to be able to carry out a safe evaluation. As already mentioned, the checking of an ionization smoke alarm with regard to contamination can be started if, for instance, a chamber current reduction and thus a potential increase has occurred. Alternatively, the examination can be carried out according to a fixed time schedule which, above all, is advantageous if, as in systems working in an analog manner, the evaluation of the data is not carried out at the individual smoke alarms but in a central office.

According to the invention, a possibility of carrying out a measurement at another field strength consists in associating the check circuit with a switch-over device which changes the field strength in the measuring chamber by applying different supply voltages. Alternatively, it can be provided that in the measuring chamber, by a specific structure of the same, at least two different field strength ranges are always formed in the same. For this, an embodiment of the invention provides that the measuring chamber contains at least two pairs of electrodes which are connected to different voltages and that the measuring electrodes of the two pairs are connected to the check circuits. Alternatively, the measuring chamber can have at least two separated measuring electrodes connected to the check circuit as well as a common counter electrode. The counter electrode includes two electrode portions associated with the measuring electrodes, said portions being differently spaced with respect to the associated measuring electrodes. If a predetermined voltage difference with regard to the normal condition is reached with the chamber range working in the smaller field strength range, or with the measuring electrode associated therewith also in the range working with the higher voltage, a voltage difference corresponding to the field strength can be observed if smoke aerosols have an effect. However, if a dirt deposition on the radioactive member is the reason for the potential change in the one chamber range, in the other range a voltage change will occur in a correspondingly significant manner. With the last-cited construction, possible deviations are primarily dependent on the design of the transition ranges of the measuring chamber, especially on the field strength acting there.

DETAILED DESCRIPTION OF THE PREFERRED EMBODIMENTS

Figure 1:
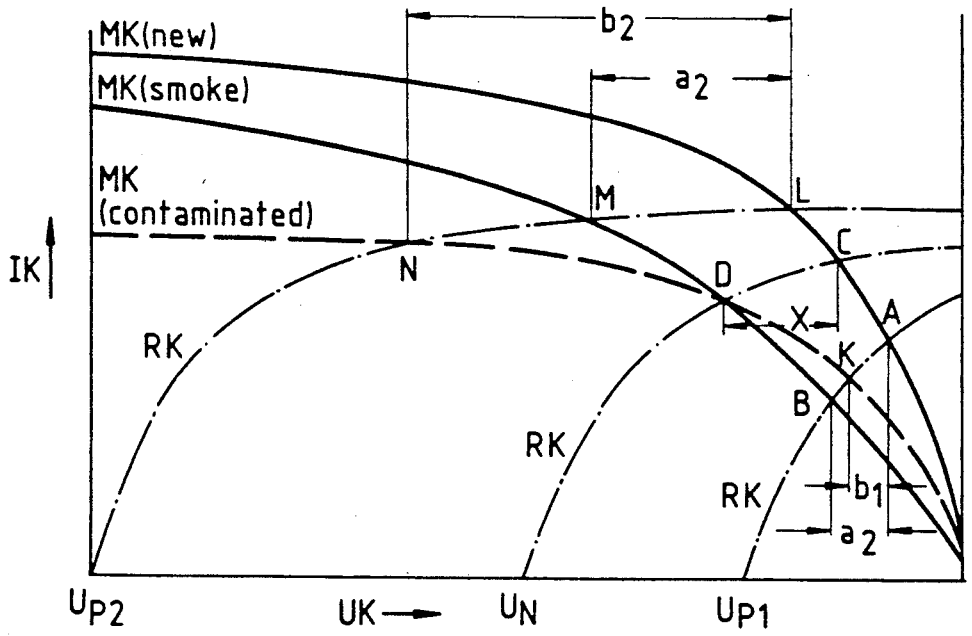
FIG. 1 shows a current-voltage-diagram of an ionization smoke alarm for different conditions.

Before the details shown in the drawings are commented on, it is to be pointed out that each of the described features per se or connection with features of the specification can be of inventive importance.

FIG. 1 shows characteristic curves for chambers of an ionization smoke alarm in which there is an ionization measuring chamber, which is freely accessible for the ambient air, and a closed ionization reference chamber which are connected in series with one another. Each of the chambers includes a radioactive member. The chamber voltage UK is shows on the abscissa while the chamber current IK is shown on the ordinate. The characteristic curves with solid lines show the course of the characteristic curves of the measuring chamber in its new condition MK (new) and in the presence of smoke MK (smoke) of predetermined constant density. The dash-dotted characteristic curves RK show the course of the characteristic curves of the reference chamber. The dotted characteristic curve MK (contaminated) shows the course of a characteristic curve at a significant contamination of the radioactive member in the measuring chamber.

On the assumption of a normal voltage $U_N$ applied across both chambers, a voltage potential according to the point of intersection C results at the common measuring electrode between the chambers in the series interconnection thereof indicating the division of this two chamber voltage across each chamber. If, during operation, a potential displacement is observed at the measuring electrode, for instance, the voltage difference X, a point of intersection D is reached. Now, for the provision of another field strength, the voltage across the two chambers is varied according to the invention, for instance, by going down to the two chamber voltage value $U_{P1}$. In the new condition of the measuring chamber, the working point A would result at the measuring electrode. However, if smoke has been the reason for the potential change X, the lowered characteristic curve MK (smoke) becomes valid. Accordingly, the potential B will result at the measuring electrode upon application of the reduced chamber voltage. The potential difference between A and B is $a_1$. However, if dirt on the radioactive member has been the reason for the potential change X, the measuring chamber characteristic curve MK (contaminated) becomes valid and a point of intersection K results, i.e. only the potential difference $b_1$ is reached.

If after occurrence of the voltage difference X has occurred, the two chamber voltage is switched to a higher value $U_{p2}$, the potential L for a new condition chamber would result at the measuring electrode. However, if smoke is in the chamber, the point of intersection M results, i.e. the potential difference $a_2$. Now, this can be evaluated for the smoke detection. However, if a contaminated radiator has been the reason for the potential change X at the nominal voltage the point of intersection N would result at the higher check value two chamber voltage. This high potential difference $b_2$ would not be suited for a safe detection of dirt. The very high potential differences result from the fact that the characteristic curves are substantially located in the saturation range at the higher chamber voltage.

However, one can immediately determine whether smoke or dirt has been the reason for the potential reduction at the normal two chamber voltage upon a reduction of the two chamber voltage to smaller evaluation potential differences with respect to the normal voltage. With the selected locations of the characteristic curves and points of intersection, not only do higher potential differences occur, but also significant differences result with regard to the reason for the chamber current reduction or potential change with the increase of the two chamber voltage. Furthermore, one recognizes that the ratio of the potential differences $a_1:b_1$ is larger than 1 at low chamber voltage. Compared with this, the ratio of the potential differences $a_2:b_2$ is smaller than 1 at a higher check value two chamber voltage than the normal voltage. If one changes from a medium normal chamber voltage, a deposition of dirt has a smaller effect than smoke at a smaller check value of the two chamber voltage. However, at a higher check value of the two chamber voltage, dirt has a significantly higher effect than smoke in the measuring chamber. As already mentioned, high potential differences result in saturation conditions in the chambers, especially at the shown check value of two chamber voltage $U_{P2}$, which enables an exact evaluation of the respective smoke density or a clear determination that dirt is present on the radiator.

Figure 2:
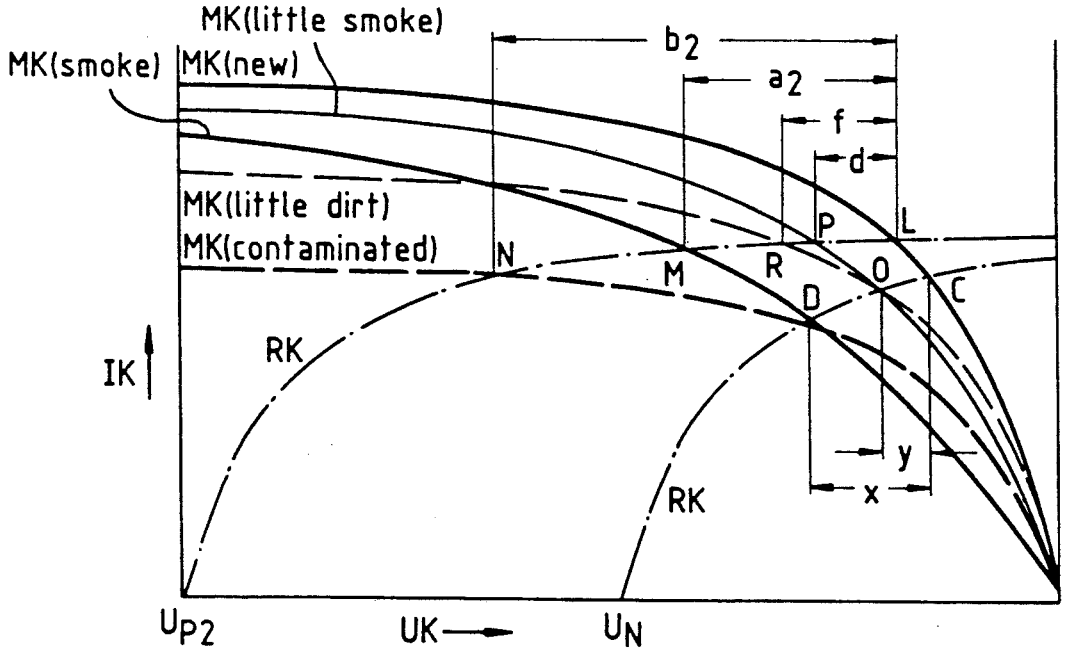
FIG. 2 shows a similar diagram as FIG. 1 with additional characteristic curves.

The diagram of FIG. 2 is substantially the same as that of FIG. 1. However, it shows a mere detailed evaluation possibility according to the inventive method. The solid lines MK (new) and MK (smoke) as well as the dotted line MK (contaminated) correspond to the lines according to FIG. 1. An additional characteristic curve MK (little smoke) characterizes the measuring chamber at a predetermined identical smoke density during the measurement. An additional characteristic curve MK (little dirt) characterizes the measuring chamber at smaller dirt depositions on the radioactive member. The locations of the reference chamber characteristic curves is identical with the corresponding reference chamber curves in FIG. 1.

If not much smoke is in the measuring chamber, the potential difference y results at the measuring electrode. This can be the reason for switching over to a higher check value of two chamber voltage $U_{P2}$. If smoke has been the reason for the potential change y, the measuring electrode voltage will displace from the point of intersection L to the point of intersection P which causes a potential change d at the measuring electrode. However, if dirt has been the reason, the measuring chamber characteristic curve gets the cited course MK (little dirt). Changing from the point of intersection at $U_N$ which is reached after the occurrence of the potential difference y, the potential of the measuring electrode at the check value of two chamber voltage $U_{P2}$ is shifted to the point of intersection R. Now, the potential difference from the point L to the point R reaches the higher value f through the effect of dirt instead of the difference d through the effect of smoke. The potential difference d can serve as a pre-alarm for little smoke, and, upon occurrence of the potential difference f, the same can be evaluated as an indication of a necessary cleaning of the ionization alarm.

After having finished the evaluation, the two chamber voltage can be switched back to is normal value $U_N$. However, if during operation the potential difference at the measuring electrode becomes higher and, for instance, reaches the value x, the two chamber voltage is again switched over to the higher check value thereof, voltage $U_{P2}$. As already described in connection with FIG. 1, upon the presence of smoke, the potential difference $a_2$ will result for an alarm evaluation or the potential difference $b_2$ will result for the deposition of dirt. Potential difference $b_2$ points to a considerable contamination of the alarm and, at a very high degree of contamination, can be evaluated as an indication of a smoke alarm which is no longer completely functional.

Figure 3:
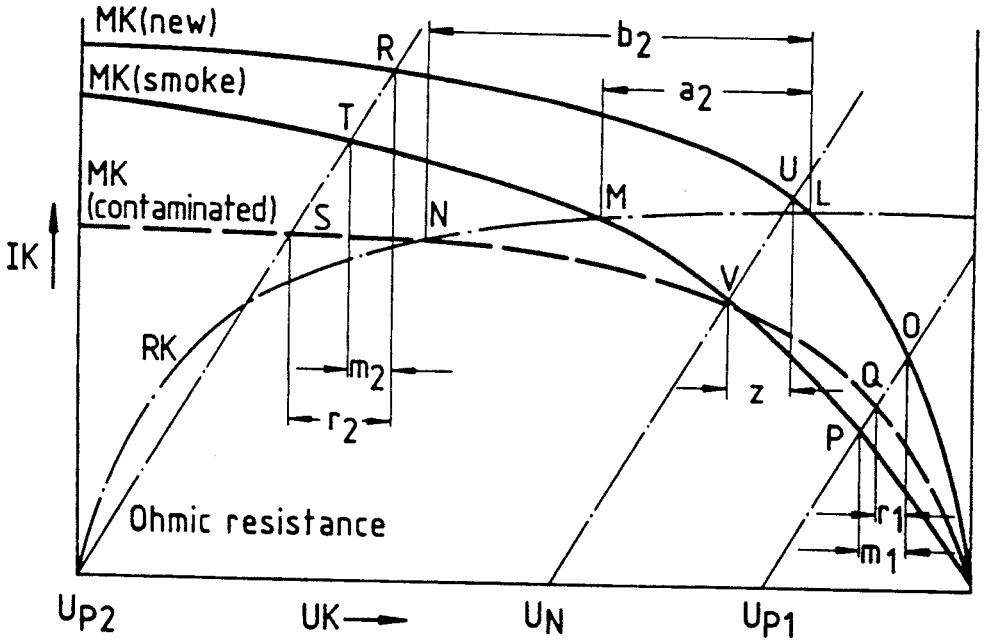
FIG. 3 shows a similar diagram as FIGS. 1 and 2, however, with the use of an ohmic resistance as a reference for the measuring chamber.

The diagram according to FIG. 3 is based upon an arrangement of chambers according to which the ionization reference chamber is replaced by an ohmic resistance in the series connection with the measurement chamber. The resistance line passing the point $U_N$ intersects the new condition measuring chamber line in point U. If a potential difference z is achieved due to a change of the chamber current, switch to the low check value resistor and chamber voltage $U_{P1}$ is made. Now, the point of intersection P with the characteristic curve MK (smoke) results through the influence of smoke. The potential difference $m_1$ is reached. Upon the influence of dirt, the characteristic curve of the measuring chamber becomes MK (contaminated) which is shown by a dashed line. The resistance line at $U_{p1}$ intersects the dashed characteristic curve of the measuring chamber in point Q. Now, the potential difference has the value $r_1$. Upon switching to a higher check value resistor and chamber voltage $U_{P2}$, the point of intersection T and the potential difference $m_2$ result upon the influence of smoke. However, upon the influence of dirt, the measuring electrode potential is displaced to the point of intersection S, and the potential difference $r_2$ is measured. The differences determined according to the arrangement of FIG. 3 are smaller than the potential differences results according to FIG. 1; however, also in this latter case, the ratio $m_1:r_1$ exceeds 1 (check value resistor and chamber voltage $U_{P1}$). At the check value resistor and chamber voltage $U_{P2}$ the corresponding ratio $m_2:r_2$ is smaller than 1. Accordingly, an unambiguous evaluation of whether dirt or smoke caused the chamber current change can be carried out.

In order to make a very detailed and safe determination with regard to the smoke density and the degree of contamination, it can make sense to additionally switch over to a reference chamber (characteristic curve RK in FIG. 3). Now, with identical chamber conditions, the points of intersection L, M and N and thus the potential differences $a_2$ and $b_2$ would be suited for a very exact evaluation.

Furthermore, a defined locations for the characteristic curve can also be adjusted by means of a resistance combination, and possibly a reference chamber, in order to get potential differences with which primarily either the influence of smoke or the influence of dirt can be evaluated in a preferred manner.

As already mentioned, the evaluation of whether smoke is present in the alarm, or whether contamination is present, can be done within the alarm itself or at a central location. If the evaluation is made at a central location it can be advantageous to also carry out a change of the electric field strength from a central location, for example by changing the supply voltage from line extending therebetween to line. However, if one selects an embodiment according to which the ionization chambers and the circuit are disposed within a common housing, it is useful to carry out the check process with each alarm dependent on its respective measuring chamber condition. In order to be able to carry out a check automatically at only a specific smoke alarm working on the same alarm line, i.e. voltage supply line, and to leave the other alarms in the condition of supervision, changing the two chamber voltage or varying the field strength must be practically carried out in only the alarm which has to be checked. It is a matter of course that the necessary change-over arrangements and the necessary evaluation and signal components be contained in the electronic circuit of the alarm.

The above-described method has the advantage that it can be carried out with conventional ionization chambers. However, if it is necessary to give alarm of a fire developing very rapidly in a short time, the arrangement to be described in the following is preferred.

Figure 4:
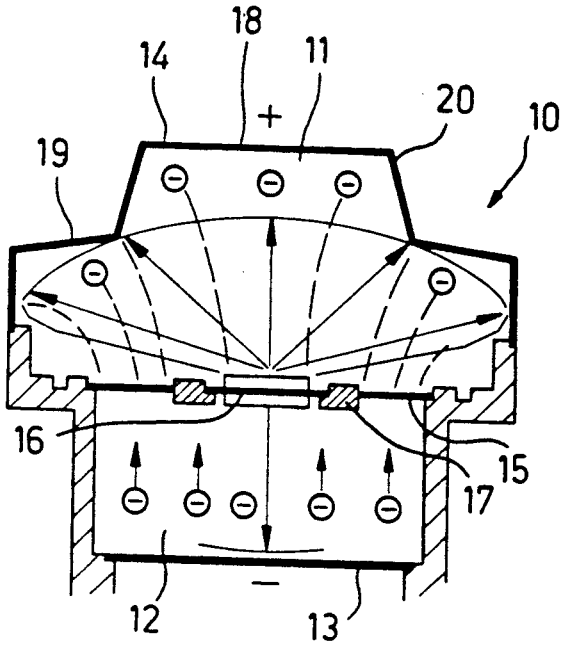
FIG. 4 shows a sectional view of an ionization chamber arrangement according to the invention with different field strength ranges.

In FIG. 4 an ionization chamber arrangement 10 is shown which consists of a measuring chamber 11 and of a reference chamber 12. The reference chamber 12 has a reference chamber electrode 13 and the measuring chamber 11 includes a outer measuring chamber electrode 14. Both chambers 11 and 12 have a common measuring electrode 15 as well as an inner measuring electrode 16 which are separated from one another by a suitable insulation 17. Radioactive radiators are located on both sides of the inner measuring electrode. The arrows in the chambers 11 and 12 are to show the range of action of the radioactive radiators. The electrodes 13, 15 and 16 are planar in form. However, the outer electrode 14 is formed with a step in a cup-like manner with a central portion 18 and a portion 19 annularly extending around the central portion. These portions are connected through a substantially axial annular wall portion 20. Thereby the central measuring electrode 16 largely cooperates with the central portion 18 of the outer electrode 14, and the outer measuring electrode 15 substantially cooperates with the outer annular portion 19 of the outer electrode 14. Accordingly, in the measuring chamber 11 two ranges of different field strengths are present if one does not take into consideration the transition ranges of the field strength. For example, a supply voltage of 12 V is applied to the outer electrode 14 and the reference chamber electrode 13. As mentioned, the field strength in the central range is smaller than in the outer range since the outer electrode 14 portion 19 has a smaller distance to the outer measuring electrode 15 than the central portion 18 has to the inner measuring electrode 16. If, according to the chamber arrangement of FIG. 4, the deposition of dirt on the radioactive radiator of the measuring chamber 11 is the reason for a change at the inner measuring electrode 16 which is operated in the range of the smaller field strength, a deviating potential will occur at the outer measuring electrode 15 which works in the range of the higher field strength. If one compares this with FIG. 1, and if the potential at the inner electrode 16 would have been displaced from the operation point C to point D, then at the outer electrode 15 the potential L is displaced to point N. In this example which serves for the clarification of the method, the balance currents flowing on account of the potential difference between the measuring electrodes have not been taken into account. However, if smoke is the reason for the potential decrease, changed values occur at the electrodes 15 and 16 and, since the agglomeration of ions at smoke aerosols is better in the range of a smaller field strength, the larger change occurs at electrode 15 where the potential L is displaced to point U than in the ranges of higher field strength. The conditions shown in FIGS. 1 to 3 can be used in a corresponding manner.

Such a chamber arrangement has the advantage that time delays after changing over to one or a plurality of different field strengths on account of the respective transient effects can be avoided.

Figure 5:
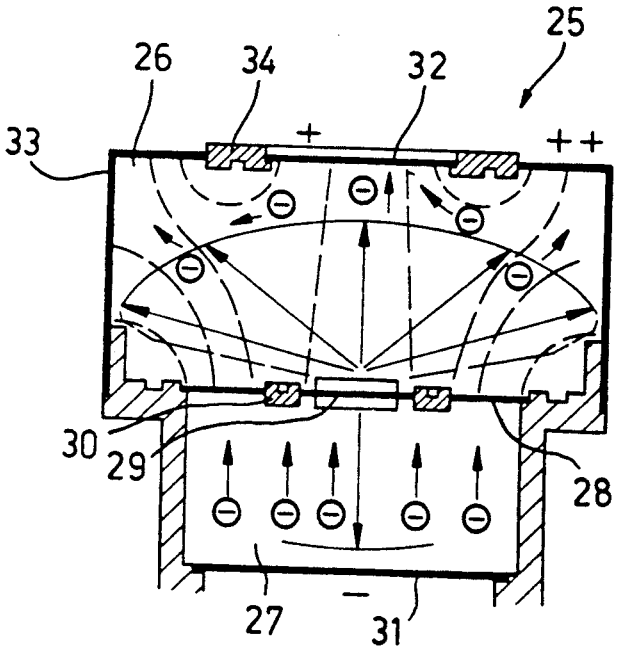
FIG. 5 shows another ionization chamber arrangement with different field strength ranges.

The chamber arrangement 25 shown in FIG. 5, in its essential parts, is the same as that of FIG. 4. A measuring chamber 26 and a reference chamber 27 are separated from one another by an outer measuring electrode 28 and an inner measuring electrode 29 which are separated by an insulation 30. The inner measuring electrode 29 has on both sides a radioactive radiator, respectively. The arrows show the range of action of the radiation. The reference chamber 27 includes a reference chamber electrode 31, and the measuring chamber 26 has an outer electrode which is formed by an inner part electrode 32 and an outer part electrode 33 which are insulated from one another by an annular insulation 34. The inner part electrode 32 is also planar in form as are measuring electrodes 28, 29 and the reference chamber electrode 31. A part of the outer part electrode 33 also has a planar form. This part is joined by a cylindrical portion by which the chamber 26 is terminated. A first voltage is applied to the central part electrode 32, and another voltage is applied to the outer part electrode 33 whereby two ranges of different field strength result in the measuring chamber 26 (again the transition ranges are not taken into account). The central measuring electrode 29 is substantially associated with the central part electrode 32, while the annular outer measuring electrode 28 is associated with the annular part electrode 33.

Applied to the example of FIG. 1, the normal two chamber supply voltage can be $U_N$ and the check value two chamber voltage can be $U_{P2}$. Also in the range operating with the higher voltage $U_{P2}$ a voltage difference corresponding to the field strength can be observed if a predetermined voltage difference with regard to the new condition is reached in the measuring chamber for the associated measuring electrode operating in the smaller field strength range upon the influence of smoke aerosols. However, if the deposition of dirt on the radioactive member is the reason for the potential change in the one chamber range, in the other range a voltage change will occur in a correspondingly significant manner differing from that when smoke is the cause.

In the FIGS. 4 and 5 it was presupposed that the inner and outer measuring electrodes are at the same electrical potential in their new condition at the normal the chamber operating voltage. This can be achieved by a corresponding geometrical dimensioning of the measuring chamber ranges operated with different field strengths, for example by the selection of mating measuring electrodes surfaces, chamber volumes as well as also by the number of ion pairs in the two measuring chamber part ranges formed by the radioactive radiation. If different potentials occur at the two measuring electrodes during operation because of the influence of smoke or dirt, a corresponding change of the electrical field results. Thereby the presence of balance currents is favoured, especially in the range around the electrical insulation between part measuring electrodes. These balance currents result in a reduction of the potential differences and have to be taken into account when the measuring thresholds are fixed.

Figure 6:
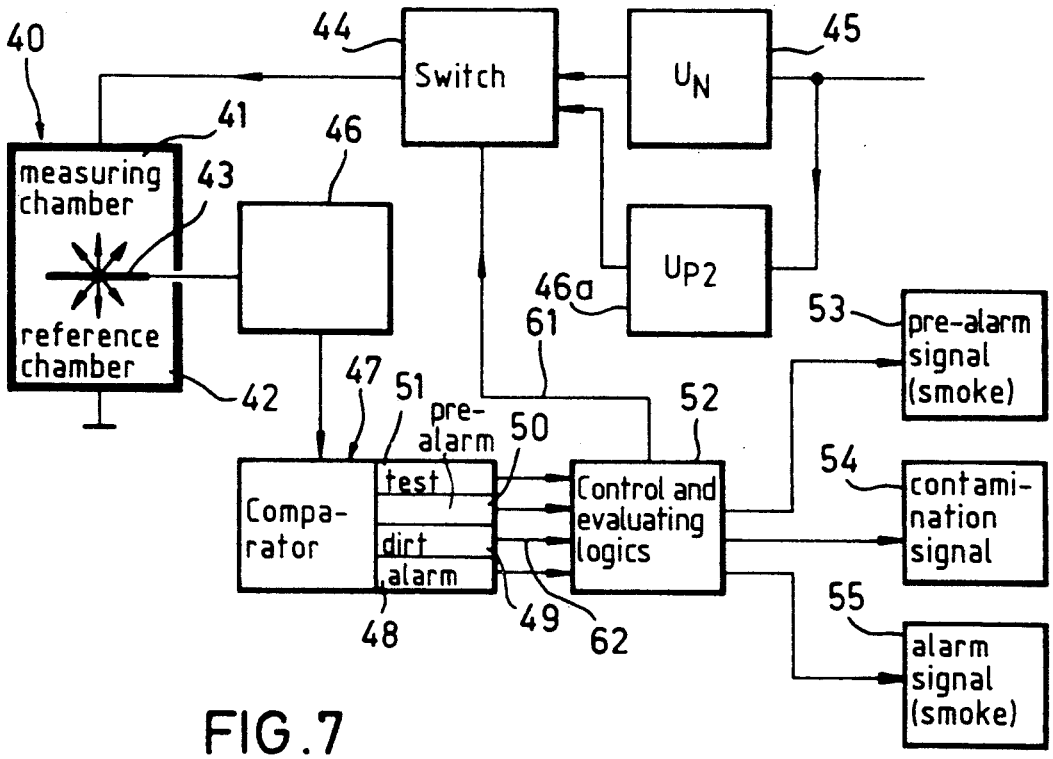
FIG. 6 shows a block diagram for the operation of an ionization smoke alarm according to the invention.

In FIG. 6 a conventional ionization chamber arrangement 40 is shown. The chamber arrangement consists of a measuring chamber 41 and a reference chamber 42 connected in series therewith, the common inner electrode or measuring electrode 43 bearing a radioactive radiator at both sides thereof. By means of a switch 44 the chamber arrangement 40 has applied to it the normal operation two chamber voltage $U_N$ (block 45) or a two chamber check voltage $U_P$ (block 46*a*). A comparator 47 is connected to the measuring electrode 43 by means of an electronic circuit 46 which preferably contains a field effect transistor. Four thresholds stages are provided within the comparator 47, namely alarm threshold 48, dirt threshold 49, pre-alarm threshold 50 and test threshold 51. Control and evaluation logics 52 are connected to the output terminal of the comparator 47. One output terminal thereof is connected to a pre-alarm signal stage 53 for smoke, one is connected to a contamination signal stage 54 and one to an alarm signal stage 55.

The shown circuit functions in following manner. During the normal operation using two chamber voltage $U_N$ only, low field strengths of a few V/cm are effective for the ion transport in the chambers 41 and 42. The potential occurring at the measuring electrode 43 is supplied to the comparator 47. If the potential reaches the test threshold 51, for instance potential O in FIG. 2, a corresponding signal is fed to the control and evaluation logics. A switch 44 is operated by the same and is switched over to a higher check value two chamber voltage $U_{P2}$ (46*a*). If a potential R occurs during the check time at the higher two chamber voltage, or the higher electric field strength, the comparator responds with its dirt threshold value, and a contamination signal is produced in stage 54 by means of the control and evaluation logics. However, if this potential is not reached but the potential P is instead reached, the pre-alarm threshold 50 is reached by means of the comparator 47 and a pre-alarm signal is provided by means of the control and evaluation logics 52. This signal means that a small smoke density is present. The control and evaluation logics of the alarm leave switch 44 in this condition in order to immediately give alarm (alarm signal stage 54) at a further smoke increase after having reached the alarm threshold 48. However, if within a predetermined time the alarm threshold is not reached, or the measurement electrode potential no longer reaches, potential P having subsequently fallen short (towards the normal value L), the alarm is again switched back to its normal supervising condition with switch 44 again providing the normal two chamber voltage $U_N$. However, if the test threshold potential O should be again reached, a new test cycle is then again produced.

Figure 7:
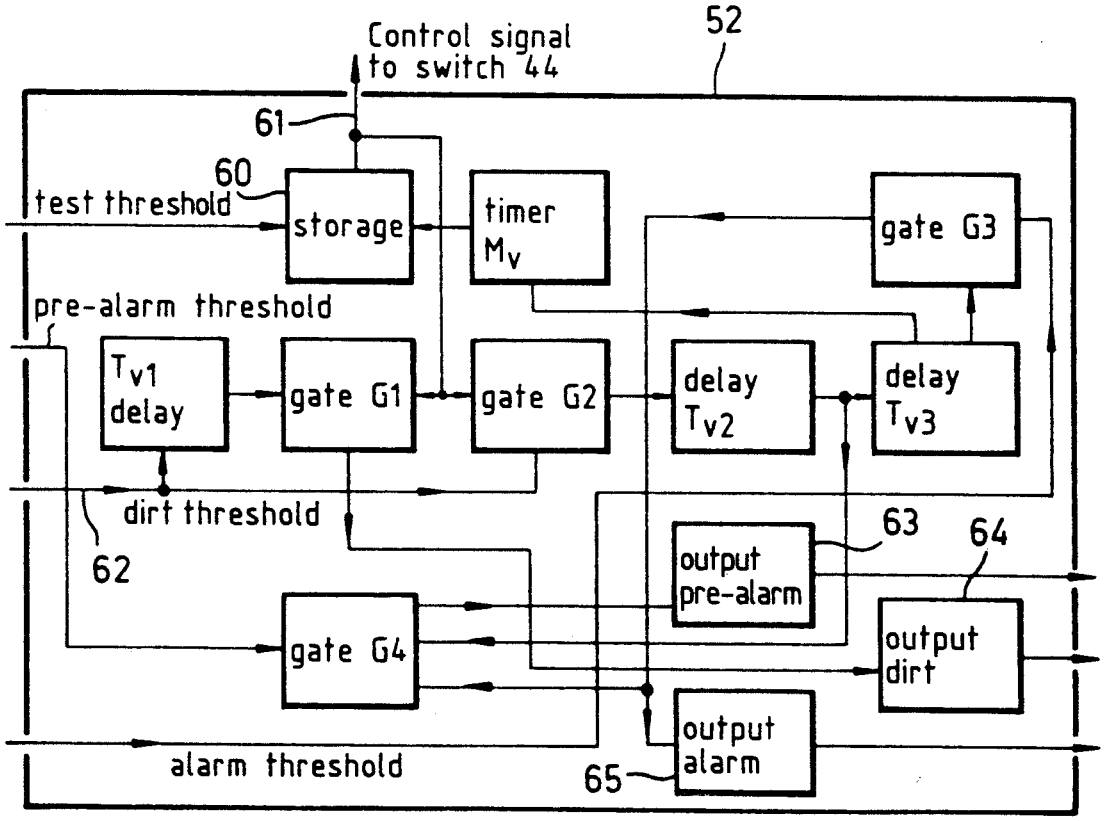
FIG. 7 shows in a detailed manner the functional flow for the control and evaluation logics of the block diagram according to FIG. 6.

The function of the control and evaluation logics 52 is shown in FIG. 7 in a more detailed manner. If the test threshold 51 is reached (FIG. 6) a storage 60 is set and a control signal is applied to the switch for the voltage switch-over (line 61). In order to introduce a further evaluation of the measuring electrode potentials but after the transient state caused by the voltage switch-over ends, a delay element $T_{v1}$ starts to work. This element is connected to the contamination threshold 49 by means of the line 62. If the signal (potential R is FIG. 2) responding to the contamination is present after termination of the delay time, a signal from the storage 60 corresponding to the occurrence of the higher voltage $U_{P2}$ is present at the gate G1 as second AND-condition. A signal is then sent from gate G1 to the output terminal 64 signalling contamination, and a contamination signal (stage 54; see also FIG. 6) is produced. If the threshold (contamination; potential R is FIG. 2) is not reached after expiration of the delay time, a gate G2 receives an inverse signal. Furthermore, a signal from the storage 60 characterizing the higher operation voltage is present at the gate G2 then also. A gate G2 triggers a delay element $T_{v2}$, the time constant of which is larger than that of the delay element $T_{v1}$. After expiration of the time from $T_{v2}$, the observation time is started by a timer $T_{v3}$. If the alarm threshold at the higher check voltage is reached within the observation time set by this timer, the conditions of a gate G3 are fulfilled. A signal is fed to the alarm output terminal 65 and thus the alarm signal is given (stage 55; see also FIG. 6). However, if the alarm threshold is not reached during the observation time, but the potential P representing a small smoke density is present, the conditions for a gate G4 are fulfilled, and a signal is fed to the pre-alarm output terminal 63 and a pre-alarm signal is produced (stage 53: see also FIG. 6). If during the observation time a further potential displacement caused by smoke increase should not occur, a signal is fed to a timing element $M_v$ by the delay stage $T_{v3}$. This timing element bridges the transient stage which occurs due to the resetting into the supervising condition at the normal two chamber supply voltage. Simultaneously the storage 60 is reset. Again, the alarm functions under normal conditions. However, if the test threshold 51 is again reached, a new check cycle follows. It is self-evident that equivalent threshold values which are stepped in a finer manner can be used with an extended check.

It is not necessary for carrying out the method that complete control, evaluation and signal electronics as described-above are individually associated with each ionization fire alarm. At least a part of the said electronics can be located in the supervision central office so that it can be connected to the respective alarm which has to be checked either in a predetermined order or after having reached predetermined chamber current changes for the evaluation according to the method.

Although the present invention has been described with reference to preferred embodiments, workers skilled in the art will recognize that changes may be made in form and detail without departing from the spirit and scope of the invention.

I claim:

1. A system for detecting smoke, said system comprising:

a first device, said first device comprising:

a chamber open to ambient atmosphere, said chamber including:

a radioactive source within said chamber for ionization of a selected portion of said atmosphere within said chamber; and a first pair of electrodes spaced apart;

a supply circuit connected to said first pair of electrodes suited for connection to an electrical energization source for providing at least temporarily a first voltage across said first pair of electrodes to establish a first field strength therebetween, said supply circuit having a supply circuit parameter value for a supply circuit parameter having a characteristic variation based on environmental factor variation within said chamber;

an initiation circuit for measuring said supply circuit parameter value with said first field strength present and generating an initiation signal if said supply circuit parameter value reaches a selected first reference value; and means for determining a characteristic of environmental factor variation within said chamber, including:

means for providing a second field strength occurring at least temporarily within said chamber and determination circuit means, for producing a determination signal indicative of environmental factor variation within said chamber based on a comparison of (a) a determination circuit parameter value of a determination circuit parameter responding to said second field strength to exhibit a characteristic variation based on environmental factor variation within said chamber with (b) a selected second reference value.

2. The system of claim 1 wherein said selected second reference value is selected such that it is representative of said determination circuit parameter value with said second field strength present and with a selected amount of smoke in said chamber, said determination circuit parameter value, in a selected magnitude range which excludes said selected second reference value, representing a condition in said chamber where less smoke is present than that chamber condition represented by said selected second reference value, and wherein said determination signal is an alarm signal produced if said determination circuit parameter value is sufficiently beyond said range on that side thereof in which said selected second reference value occurs with said second field strength present.

3. The system of claim 2, wherein said determination circuit parameter is a voltage potential across a portion of a path between said first pair of electrodes.

4. The system of claim 2, wherein said determination circuit parameter is an ionization current conducted over a portion of a path between said first pair of electrodes.

5. The system of claim 1 wherein said selected second reference value is selected such that it is representative of said determination circuit parameter value with said second field strength present and with a selected amount of contamination, by a contaminant other than smoke, on said radioactive source, said determination circuit parameter value in a selected magnitude range excluding said selected second reference value representing a condition of said radioactive source where less contamination is present than that chamber condition represented by said selected second reference value, and wherein said determination signal is a contamination signal indicating if said determination circuit parameter value is sufficiently beyond said range on that side thereof on which said selected second reference value occurs with said second field strength present.

6. The system of claim 5 wherein said determination circuit parameter is a voltage potential across a portion of a path between said first pair of electrodes.

7. The system of claim 5 wherein said determination circuit parameter is an ionization current conducted over a portion of a path between said first pair of electrodes.

8. The system of claim 1 wherein said determination circuit parameter value with said second field strength present is compared with said selected second reference value if said supply circuit parameter value with aid first field strength present reaches said selected first reference value.

9. The system of claim 1 wherein said determination circuit parameter value with said second field strength present is repeatedly compared with said selected second reference value at selected times.

10. The system of claim 1 wherein said determination signal is produced if said first supply circuit parameter value reaches said selected first reference value.

11. The system of claim 1 wherein said determination circuit parameter value is measured in the presence of said second field strength that is greater than, at least temporarily, said first field strength.

12. The system of claim 1 wherein said determination circuit parameter value is measured in the presence of said second field strength that is less than, at least temporarily, said first field strength.

13. The system of claim 1 wherein said selected first reference value, a source contamination second reference value and an environmental contamination second reference value are each stored, said source contamination second reference value representing a threshold value for contamination deposited on said radioactive source and said environmental contamination second reference value representing a threshold value for environmental contaminants within said chamber.

14. The system of claim 1 wherein said means for determining said characteristic of environmental factor variation within said chamber remains activated for a selected time when said initiation signal is generated and is not activated if said determination circuit parameter value with said second field strength present goes beyond a third selected reference value.

15. The system of claim 1 wherein said means for determining said characteristic of environmental factor variation within said chamber is located within a housing for said first device.

16. The system of claim 1 wherein said system includes a plurality of sensing devices similar to and including said first device with each of said plurality having a chamber spatially separated from those others thereof and having supply circuits, initiation circuits and determination means for determining a characteristic of environmental factor variation therefor as part of a central means for determining said characteristics of environmental factor variations associated with each said chamber.

17. The system of claim 1 wherein said means for providing said second field strength further includes a second voltage supply suited for connection to said electrical energization source which, if connected to said electrodes, produces said second field strength therebetween, and said means for determining said characteristic of environmental factor variation within said chamber further includes a switch means for disconnecting, at least temporarily, said supply circuit from said first pair of electrodes and connecting, at least temporarily, said second voltage supply thereto.

18. The system of claim 1 wherein said determination circuit means is capable of being operated continuously.

19. The system of claim 1 wherein said determination circuit means is capable of being operated intermittently.

20. The system of claim 1 wherein said means for determining said characteristic of environmental factor variation within said chamber is capable of changing said selected first reference value in accordance with said determination circuit parameter value.

21. The system of claim 5 wherein said initiation signal is made inactive if said determination circuit parameter value is sufficiently similar in value to said selected second reference value.

22. The system of claim 1 wherein said chamber further includes a second pair of electrodes, spaced apart, connected to said means for providing said second field strength, and a third pair of electrodes, spaced apart, connected to each of said initiation circuit and aid determination circuit means.

23. The system of claim 1 wherein said chamber further includes a second pair of electrodes positioned between said first pair of electrodes and connected to both said initiation circuit and said determination circuit means, said first pair of electrodes including a reference electrode and a chamber electrode, said chamber electrode having two electrode portions, each having a separation from said reference electrode differing from one another.

24. A method for detecting smoke occurring in a chamber open to ambient atmosphere, said chamber containing a radioactive source for ionization of a selected portion of said atmosphere within said chamber and at least two electrodes spaced apart, said electrodes having a supply circuit connected thereto, said supply circuit having a supply circuit parameter value of a supply circuit parameter having a characteristic variation based on environmental factor variation within said chamber with said first field strength present, said supply circuit having a determination circuit means provided therewith, said determination circuit means having a determination circuit parameter value of a determination circuit parameter having a characteristic variation based on environmental factor variation within said chamber with a second field strength present said method comprising:

applying voltage across said electrodes to form first and second field strengths at least temporarily therebetween with said supply circuit;

measuring said supply circuit parameter value with said first field strength present and said determination circuit parameter value with said second field strength present between said electrodes; and producing an initiation signal if said supply circuit parameter value in the presence of said first field strength reaches a first selected value and producing a determination signal if said determination circuit parameter value reaches a second selected value with said second reference value.

25. The method of claim 24 wherein comparing said determination circuit parameter value further comprises comparing said determination circuit parameter value at said second field strength with said selected second reference value, said selected second reference value is selected such that it is representative of said determination circuit parameter value with said second field strength present and a selected amount of smoke has entered said chamber, said determination circuit parameter value, in a selected magnitude range which excludes said selected second reference value, representing a condition in said chamber where less smoke is present than that chamber condition represented by said selected second reference value, and wherein producing a determination signal further comprises producing an alarm signal indicating the presence of smoke in said chamber if said determination circuit parameter value is sufficiently beyond said range on that side thereof on which said selected second reference value occurs with said second field strength present.

26. The method of claim 25 wherein said determination circuit parameter is an ionization current between said electrodes.

27. The method of claim 25 wherein said determination circuit parameter is a voltage potential between said electrodes.

28. The method of claim 24 wherein comparing said determination circuit parameter value further comprises comparing said determination circuit parameter value at said second field strength with said selected second reference value, said selected second reference value is selected such that it is representative of said determination circuit parameter value with said second field strength present and with a selected amount of contamination, by a contaminant other than smoke, on said radioactive source, said determination circuit parameter value in a selected magnitude range excluding said selected second reference value representing a condition of said radioactive source where less contamination is present than that chamber condition represented by said selected second reference value, and wherein producing a determination signal further comprises producing a contamination signal indicating contamination of said radioactive source by a contaminant other than smoke if said determination circuit parameter value is sufficiently beyond said range on that side thereon which said selected second reference value occurs with said second field strength present.

29. The method of claim 28 wherein said determination circuit parameter is an ionization current between said electrodes.

30. The method of claim 28 wherein said determination circuit parameter is a voltage potential between said electrodes.

* * * * *

UNITED STATES PATENT AND TRADEMARK OFFICE

CERTIFICATE OF CORRECTION

PATENT NO. : 5,189,399

DATED : February 23, 1993

INVENTOR(S) : HARTWIG BEYERSDORF

It is certified that error appears in the above-identified patent and that said Letters Patent is hereby corrected as shown below:

On the Title Page, in [56] References Cited, U.S. PATENT DOCUMENTS, delete "4,335,379", insert --4,335,378--

Col. 13, line 59, delete "aid", insert --said--

Col. 15, line 1, delete "aid", insert --said--

Col. 16, line 39, delete "thereon", insert --thereof on--

Signed and Sealed this

Twenty-third Day of November, 1993

*Attest:*

Bruce Lehman

BRUCE LEHMAN

*Attesting Officer*

*Commissioner of Patents and Trademarks*